US006675856B2

(12) United States Patent
Kozaki

(10) Patent No.: US 6,675,856 B2
(45) Date of Patent: Jan. 13, 2004

(54) COATING FILM TRANSFER TOOL

(75) Inventor: Hiroshi Kozaki, Osaka (JP)

(73) Assignee: Fujicopian Co., Ltd., Osaka-Fu (JP)

( * ) Notice: Subject to any disclaimer, the term of this patent is extended or adjusted under 35 U.S.C. 154(b) by 135 days.

(21) Appl. No.: 09/999,219

(22) Filed: Oct. 23, 2001

(65) Prior Publication Data

US 2003/0079841 A1 May 1, 2003

(51) Int. Cl.[7] ..... B32B 31/00

(52) U.S. Cl. ..... 156/577; 156/523; 156/579; 118/76; 242/160.4; 242/171; 242/588.6; 206/411

(58) Field of Search ..... 156/523, 577, 156/579, 574, 527, 540, 238; 242/588, 588.2, 588.3, 588.6, 160.2, 160.4, 170, 171; 118/200, 76, 257; 206/411

(56) References Cited

U.S. PATENT DOCUMENTS 5,346,580 A 9/1994 Elges et al.
5,759,270 A 6/1998 Lee
5,772,840 A 6/1998 Morinaga
6,145,770 A * 11/2000 Manusch et al. ..... 242/422.4
6,273,169 B1 8/2001 Ono et al.

FOREIGN PATENT DOCUMENTS

DE 4034145 A1 * 10/1991 ..... B05C/1/14
JP 2532967 1/1997

* cited by examiner

*Primary Examiner*—Richard Crispino
*Assistant Examiner*—Cheryl N. Hawkins
(74) *Attorney, Agent, or Firm*—Howson and Howson

(57) ABSTRACT

In a coating film transfer tool, a tape is unwound from a supply reel, fed over a transfer head, and wound onto a take-up reel driven from the supply reel by a drive mechanism having slippage. Instead of setting the average slipping torque at a high value, or minimizing its variations, to prevent it from falling below the winding threshold, the initial slipping ratio is set at a value of at least 34%. This avoids slackening of the tape without the need for close manufacturing tolerances or lubricants, and without causing a condition in which excessive force is required to wind the tape onto a take-up reel in the later stages of the tool's useful life.

4 Claims, 2 Drawing Sheets

COATING FILM TRANSFER TOOL

FIELD OF THE INVENTION

This invention relates to coating film transfer tools for transferring a coating film onto a receiving surface. The coating film may be an opaque correction film for masking errors in typewritten matter, drawings and the like. Alternatively, the coating film may be an adhesive, a decorative coating, or other material that is to be transferred onto a surface as a coating.

BACKGROUND OF THE INVENTION

A typical conventional coating film transfer tool comprises a casing into which are built two shafts, one for rotatably supporting a supply reel, and the other for rotatably supporting a take-up reel. A transfer head projects from the casing, and a transfer tape, consisting of a tape base material coated with a coating film, is wound on the supply reel. The base material extends over the transfer head to the take-up reel, and, at the location of the transfer head, the coating film may be transferred from the tape base material to a receiving surface, under pressure applied to the tape by the transfer head. As the transfer operation takes place, the tape is fed from the supply reel, and the base material which remains after the transfer of the coating film takes place at the transfer head, is wound onto the take-up reel.

A drive mechanism, for effecting cooperative rotation of the reels, typically comprises a rubber belt extending over pulleys formed on both reels.

The drive mechanism effects cooperative rotation of the reels such that, in the absence of slippage, the length of the tape base material to be wound onto the take-up reel would exceed the length of the tape fed by the supply reel. Since the length of the tape base material to be wound onto the take-up reel is always greater than the length of tape to be fed from the supply reel, the tape is, at least in theory, prevented from slackening. However, a large tension would be applied to the tape base material in the absence of slippage. Excessive tension on the tape base material is avoided by providing for slippage between elements of the drive mechanism.

The torque in the drive mechanism while slippage is taking place is referred to as "slipping torque". The magnitude of the slipping torque tends to vary periodically as a result of contact conditions between reel support shafts and the reels, deformation of various mechanical parts, variations in manufacturing tolerances, and other causes. If the slipping torque falls below a certain level, the take-up reel can no longer wind the tape base material during a film transfer operation, and the tape base material will begin to slacken. The value of the slipping torque at which this phenomenon occurs is called the "winding threshold".

The term "slipping ratio" as used herein refers to the ratio of the excess length of tape base material demanded by the take-up reel in the absence of slippage to the length of base material fed from the supply reel. The slipping ratio, of course, changes as the diameters of the wound tape material on the reels change. In the initial stage of operation, when most of the tape base material is wound on the supply reel, and little, if any, is wound on the take-up reel, the slipping ratio tends to be at its lowest level. The slipping ratio increases, as tape is fed from the supply reel to the take-up reel.

Failures in the winding of the tape base material onto the take-up reel tend to occur especially in the initial stages of operation of the tool, when the slipping ratio is relatively low and the cycles of the periodic variations in slipping torque are relatively long.

To prevent the transfer tape base material from slackening while the transfer tool is in use, various measures have been adopted in the past. One such measure is to set the mean value of the slipping torque at a relatively high level so that, even though the slipping torque varies, its value always exceeds the winding threshold. An alternative is to keep the variation of the slipping torque as small as possible, so that it is always above the winding threshold, by improving manufacturing tolerances and precision of assembly.

In the case in which the mean value of the slipping torque is set at a high level, a relatively large force is required to feed the transfer tape from the supply reel in the later stages of operation, when the outer diameter of the transfer tape on the supply reel becomes relatively small. In the case in which measures are taken in manufacture to minimize variation of the slipping torque, parts having high accuracy are required, and lubricants or special materials are needed, and consequently manufacturing costs are increased.

SUMMARY OF THE INVENTION

An important object of this invention is to provide an improved coating film transfer tool, which reliably avoids slackening. Another object is to reduce the force required to operate the tool in the later stages of its useful life, when most of the tape base material is wound onto the take-up reel. Still another object is to reduce manufacturing costs.

To address the aforementioned objectives, the invention utilizes a drive mechanism designed to have an initial slipping ratio of 34% or more. More particularly, the coating film transfer tool in accordance with the invention comprising a supply reel, a take-up reel, a transfer head, and a transfer tape comprising a base material and a coating film on the base material. The base material of the tape is wound on the supply reel and extends from the supply reel, over the transfer head, to the take-up reel. The tool further comprises a drive mechanism connected to the supply and take-up reels for causing the take-up reel to rotate in a direction to take up base material fed over the transfer head as the supply reel rotates in a direction to feed tape toward the transfer head. The drive mechanism allows a limited amount of slippage between the supply and take up reels so that, as the tape is unwound from the supply reel, the tape base material is wound onto the take-up reel without being stretched excessively. However, the slipping ratio of the drive mechanism at an initial stage of winding, when a maximum amount of the length of the transfer base material is wound on the supply reel, is at least 34%.

Because of the high initial slipping ratio, the periods of variation in the slipping torque can be made short, and thus the time intervals during which the slipping torque is below the winding threshold are also relatively short. As a result, the transfer tape base material can be prevented from slackening without encountering the problem of excessive force in the latter stages of operation, and without taking special measures in the manufacturing process to minimize the magnitude of slipping torque variations.

Other objects, details and advantages of the invention will be apparent from the following detailed description when read in conjunction with the drawings.

DETAILED DESCRIPTION OF THE PREFERRED EMBODIMENT

Figure 4A:
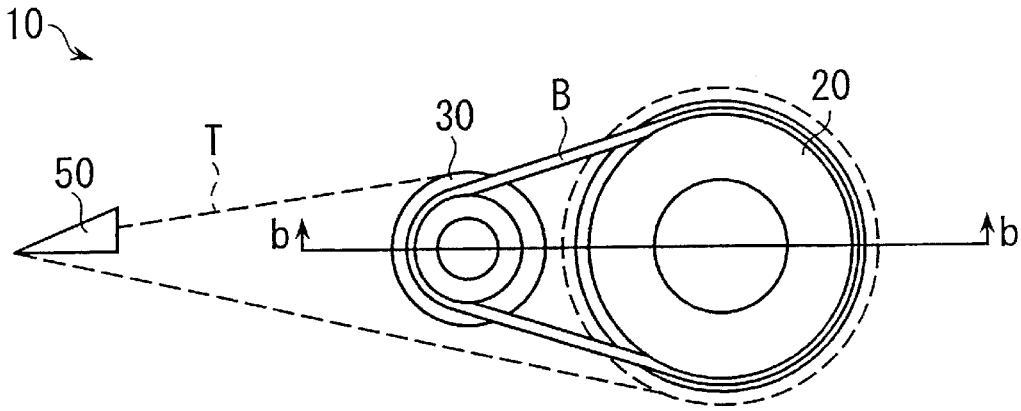
FIG. 4*a* is a schematic side elevation of a coating transfer tool in accordance with the invention.
Figure 4B:
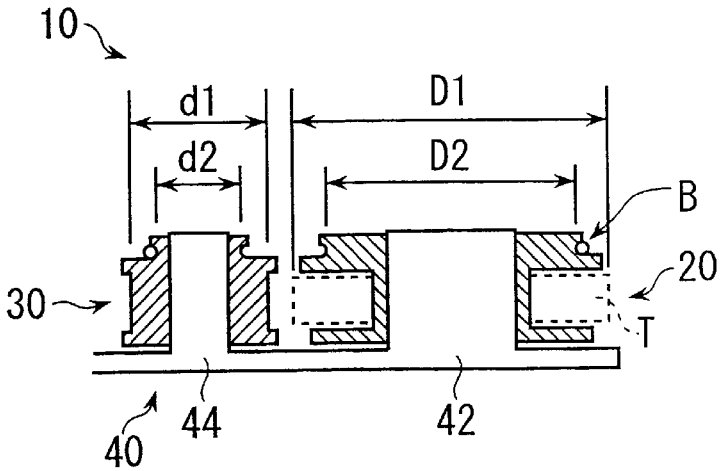
FIG. 4*b* is a sectional view taken on plane b—b of FIG. 4*a*.

FIGS. 4*a* and 4*b* show schematically the structure of a coating film transfer tool of the kind utilizing a belt drive as a drive mechanism. The transfer tool 10 comprises a casing 40 having two reel support shafts 42 and 44 extending laterally from a wall of the casing. A transfer head 50 extends outwardly from the casing 40, and a supply reel 20 and a take-up reel 30 are rotatably supported on shafts 42 and 44 respectively. A transfer tape, comprising a base tape T and a coating film carried thereon, is wound around supply reel 20. The tape extends to the transfer head 50, where the coating is transferred onto a receiving surface (not shown) under pressure applied to the tape by the transfer head. The base tape T extends from the transfer head to the take-up reel 30, and is wound onto the take-up reel as the tool is operated.

A rubber belt B, wound around pulleys integrally formed on the reels 20 and 30, effects cooperative rotation of the reels, such that, in the absence of slippage, the length of the tape base material to be wound onto the take-up reel would exceed the length of the tape fed by the supply reel, thereby preventing the tape base material from slackening. Since the length of the tape base material to be wound onto the take-up reel is greater than the length of tape to be fed from the supply reel, a fairly large tension would be applied to the tape base material were it not for slippage. Excessive force on the tape base material is avoided by providing for slippage between elements of the drive mechanism.

Figure 2:
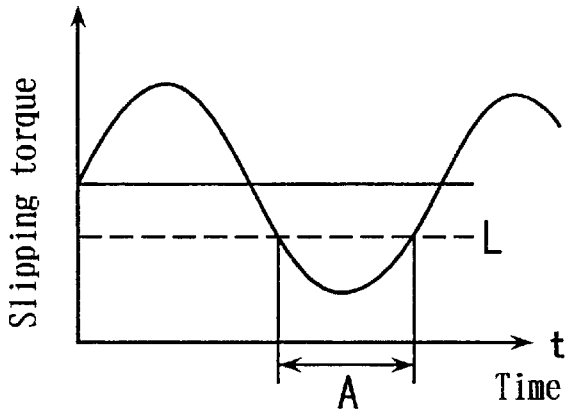
FIG.2 PRIOR ART
FIG. 2 is a similar graph, showing the variation of slipping torque with time in a conventional coating film transfer tool.

FIG. 2 illustrates the periodic variation in slipping torque in a coating film transfer tool in accordance with the prior art. As will be apparent from FIG. 2, the slipping torque falls below the threshold value L periodically for intervals lasting for a time "A". During this time, the tape can slacken to an extent such that the tape separates from the transfer head of the tool, rendering proper operation difficult, if not impossible.

Figure 3:
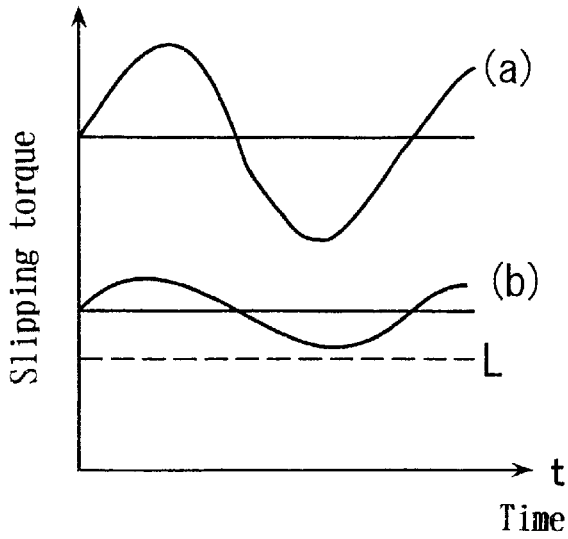
FIG.3 PRIOR ART
FIG. 3 is a graph, showing the variations of slipping torque with time in two different coating film transfer tools, in which different techniques, in accordance with the prior art, are used to avoid tape slackening.

FIG. 3 illustrates the two measures taken in the past to avoid slackening of the tape. As shown by curve "a" in FIG. 3, the average value of the slipping torque can be set to a high value such that the torque, even though it varies considerably, cannot fall below the threshold value L. The alternative is to keep the magnitude of the variations in the slipping torque as small as possible, as exemplified by curve "b". This is accomplished by improving manufacturing tolerances and precision of assembly. Here again, the slipping torque remains above the threshold value L.

As mentioned previously, the slipping ratio is the ratio of the excess length of tape base material demanded by the take-up reel in the absence of slippage to the length of base material fed from the supply reel. Whereas in prior art film transfer tools, the slipping ratio in the initial stage of winding is conventionally set at about 10% (see Japanese Utility Model Registration No. 2532967), in accordance with this invention, the slipping ratio is set at 34% or more.

As shown in FIG. 4*b*, the outside diameter of the transfer tape on the supply reel 20 is D1, and the diameter of the belt pulley on the supply reel is D2. The outside diameter of the tape wound onto the take-up reel 30 is d1. In the initial stage of operation, when no tape is on the take-up reel, d1 is considered to be the outside diameter of the take-up reel. The diameter of the belt pulley on the take-up reel is d2.

The speed reduction ratio is $$\frac{D2}{d2}.$$

Therefore, the slipping ratio S(%) of the coating film transfer tool may be expressed as follows:

$$S(\%) = \left(\frac{d1}{D1} \times \frac{D2}{d2} - 1\right) \times 100$$

The outside diameter D2 of the belt pulley of the supply reel 20 and the outside diameter d2 of the belt pulley of the take-up reel are constant. However, the diameter D1 of the tape on the supply reel decreases while the diameter d1 of the tape base material on the take-up reel increases. Therefore, the slipping ratio is initially at a minimum value when the supply reel is full, and gradually increases as tape base material is drawn off the supply reel and wound onto the take-up reel.

Experiments were conducted to determine the relationship between the initial slipping ratio and the occurrence of slackening of the tape base material.

In a coating film transfer tool corresponding to FIGS. 4*a* and 4*b*, the outside diameter D1 of the transfer tape would on the supply reel was 21 mm; the outside diameter D2 of the belt pulley on the supply reel was 16.5 mm; the outside diameter of the belt pulley on the take-up reel was 5.6 mm, and the mean value of the changes in the slipping torque when the belt was caused to slip was 100 (gf·cm). The slip ratio was changed by selecting different take-up reels having different outside diameters (corresponding to d1, as shown in FIG. 4*b*). For each coating film transfer tool, the coating film transfer operation was conducted 30 times, and the occurrences of the slackening phenomenon were observed and counted. The results of these experiments are shown in the following table.

| Diameter of take-up reel (mm) | Initial slipping ratio S(%) | Number of occurrences of slackening in initial winding |
|---|---|---|
| 8.0 | 12.2 | 10/30 |
| 9.0 | 26.4 | 1/30 |
| 9.5 | 33.3 | 0/30 |
| 10.0 | 40.4 | 0/30 |

From the table, it may be concluded that the smaller the slipping ratio S at the initial winding stage is, the more occurrences of slackening are observed, and that, if the slipping ratio S becomes 33.3% or more, no slackening was observed.

Therefore, in a coating film transfer tool, in order to prevent the transfer tape base material from slackening, it is necessary to set the slipping ratio at the initial winding stage at 34% or more.

An increase in the slipping ratio S at the initial winding stage may be achieved by any of the following measures or combinations thereof:

1. Decreasing the outside diameter D1 of the transfer tape wound on the supply reel;

2. Increasing the outside diameter D2 of the belt pulley on the supply reel;
3. Increasing the outside diameter of the take-up reel;
4. Decreasing the outside diameter d2 of the belt pulley on the take-up reel.

Figure 1:
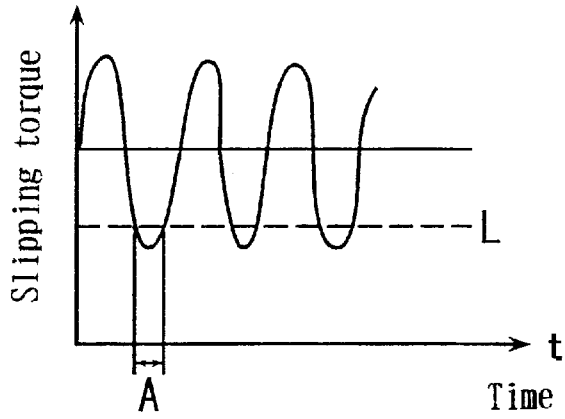
FIG. 1 is a graph showing a typical variation of slipping torque with time in a coating film transfer tool in accordance with the invention.

The reason why there should be no slackening of the transfer tape when the slipping ratio S a the initial winding stage of the tool is set at 34% or more may be the following:

By setting the slipping ratio at 34% or more, the cycles of the variation in slipping torque are shortened. Therefore, even if the slipping torque falls below the threshold value L, it will rise again quickly. In other words, the time interval A, as shown in FIG. 1, is relatively short compared to the time interval A in FIG. 2. If the slipping torque falls below the threshold value L for only a short interval, the transfer tape will not slacken.

Moreover, by employing this solution, namely setting the initial slipping ratio at 34% or more, it becomes unnecessary to maintain the slipping torque at a high level. Consequently the force required to effect movement of the tape from the supply reel to the take-up reel remains at a low level even as the winding of the tape base material onto the take-up reel is completed. In addition, because there is no need to minimize the magnitude of the variation in the value of the slipping torque, it is unnecessary to utilize lubricants or to utilize high quality, precision parts in the coating film transfer tool. Thus manufacturing costs can be kept at a minimum.

By way of summary, the invention affords the following advantages. First, by virtue of the high initial slipping ratio, slackening of the tape base material is avoided, and it is possible to utilize the tool with a comparatively small pressing force, even in the later stages of its operating life, when the tape is almost fully wound onto the take-up reel. Second the high initial slipping ratio makes it possible to reduce manufacturing costs by obviating lubricants and precision parts.

The invention is also applicable to coating film transfer tool in which, instead of a belt drive, the take-up reel is driven by the supply reel through a different drive mechanism, such as a clutch, or a combination of a clutch and gearing.

These and various other modifications may be made to the coating film transfer tool described above without departing from the scope of the invention as defined in the following claims.

I claim:

1. A coating film transfer tool comprising a supply reel and a take-up reel for transferring a coating film onto a receiving surface by a transfer head under pressure, said coating film being applied onto a tape base material to form a transfer tape and said transfer tape being adapted to be unreeled from said supply reel and said tape base material, after said transfer, being adapted to be wound by said take-up reel, and said coating film transfer tool further comprising a cooperative drive mechanism which is adapted to cause said reels to rotate cooperatively, characterized in that the slipping ratio of said cooperative drive mechanism at the initial stage of winding of said transfer tape is set at 34% or more.

2. A coating film transfer tool for transferring a coating onto a receiving surface under pressure, the tool comprising a supply reel, a take-up reel, a transfer head, and a transfer tape comprising a base material and a coating film on the base material, the base material of the tape being wound on the supply reel and extending from the supply reel, over the transfer head, to the take-up reel, and the tool further comprising a drive mechanism connected to the supply and take-up reels for causing the take up reel to rotate in a direction to take up base material fed over the transfer head as the supply reel rotates in a direction to feed tape toward the transfer head, the drive mechanism allowing a limited amount of slippage between the supply and take up reels whereby, as the tape is unwound from the supply reel, the tape base material is wound onto the take-up reel without being stretched excessively, wherein the slipping ratio of the drive mechanism at an initial stage of winding, when a maximum amount of the length of the transfer base material is wound on the supply reel, is at least 34%.

3. A coating film transfer tool according to claim 1 wherein the mean value of the slipping torque is set at a level such that the slipping torque periodically falls below the winding threshold.

4. A coating film transfer tool according to claim 2 wherein the mean value of the slipping torque is set at a level such that the slipping torque periodically falls below the winding threshold.

* * * * *